United States Patent [19]

Hiramatsu

[11] Patent Number: 4,883,008

[45] Date of Patent: Nov. 28, 1989

[54] METHOD OF AND APPARATUS FOR CONTROLLING SEWING RATE IN SEWING MACHINE

[75] Inventor: Tohru Hiramatsu, Tokyo, Japan

[73] Assignee: Juki Corporation, Tokyo, Japan

[21] Appl. No.: 263,531

[22] Filed: Oct. 27, 1988

[30] Foreign Application Priority Data

Oct. 30, 1987 [JP] Japan ..... 62-275413

[51] Int. Cl.[4] ..... D05B 69/18

[52] U.S. Cl. ..... 112/262.1; 112/221; 112/277

[58] Field of Search ..... 112/262.1, 277, 275, 112/220, 221, 121.11, 453, 456, 314, 315

[56] References Cited

U.S. PATENT DOCUMENTS

| | | | |
|---|---|---|---|
| 4,332,208 | 6/1982 | Watasue et al. | 112/277 |
| 4,340,002 | 7/1982 | Hanyu et al. | 112/453 |
| 4,386,301 | 5/1983 | Neki et al. | 112/277 X |

*Primary Examiner*—Peter Nerbun

*Attorney, Agent, or Firm*—Tarolli, Sundheim & Covell

[57] ABSTRACT

A method of and an apparatus for controlling the sewing rate in a sewing machine is disclosed that comprises a reciprocally and vertically movable needle, a motor for driving the needle and a throat plate on which a work is to be placed having a needle hole through which the needle moves reciprocally and vertically. The sewing machine is adapted to repeatedly perform a cycle in which the needle moves downwardly from the upper dead center to the bottom dead center passing through the needle hole and then upwardly from the bottom dead center to the upper dead center passing through the needle hole and the cycle is adapted to take place in such a manner that while the needle is below the throat plate the needle is moved at a rate higher than that at which the needle is moved while the needle is above the throat plate.

5 Claims, 4 Drawing Sheets

METHOD OF AND APPARATUS FOR CONTROLLING SEWING RATE IN SEWING MACHINE

BACKGROUND OF THE INVENTION

This invention relates to an improvement in methods of and apparatus for controlling the sewing rate in sewing machines.

It is generally known that there are sewing machines in which stitches are formed on a work piece to be sewn by a needle. The workpiece is movable horizontally by one or more pulse motors. The needle is reciprocated in a vertical plane by another pulse motor. In these conventional sewing machines, when the work is fed by a predetermined amount, there is a tendency for the work to be overshot (overfed) and this overshooting is then eliminated after a lapse of a certain time to attain the predetermined work feed amount. This is due to the characteristics of pulse motors.

One example of conventional sewing machine of this type is shown in FIG. 6. In such a machine although the reciprocally vertical movement rate of the needle is variable, during one cycle wherein the needle moves downwardly from the upper dead center to the bottom dead center and then upwardly from the bottom dead center to the upper dead center, the movement rate of the needle is constant, that is, the needle moves at the same rate throughout the cycle.

However, since the movement rate of the needle is constant throughout one cycle in the conventional sewing machine, any possibility of increase in the sewing rate of a machine is subject to limitation. If the movement rate of the needle is increased, there are the problems in that the needle tends to bend or break while piercing through the work, and/or skip sewing may occur.

SUMMARY OF THE INVENTION

The present invention therefore has as its object the solution of the problems inherent in the conventional sewing machine referred to above.

According to the present invention, these problems can be solved by an arrangement in which the needle is moved at a one rate while the leading end of the needle is below the throat plate and in which the needle is moved at a different rate while the leading end of the needle is above the throat plate.

DETAILED DESCRIPTION OF THE PREFERRED EMBODIMENTS

The present invention will now be described referring to the accompanying drawings in which the preferred embodiments of the invention are illustrated.

Figure 1:
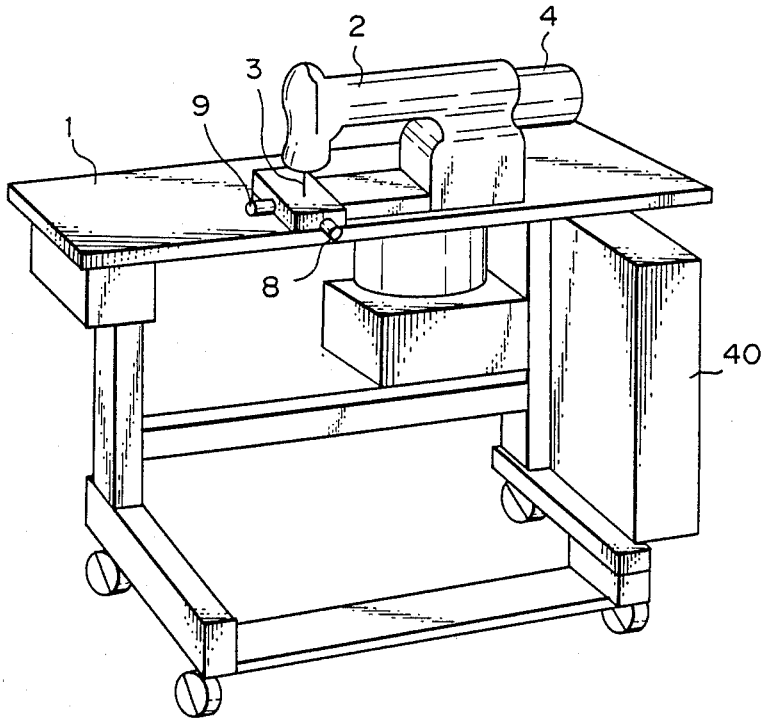
FIG. 1 is a perspective view of a sewing machine to which the sewing rate control method and apparatus according to the present invention are applied.
Figure 2:
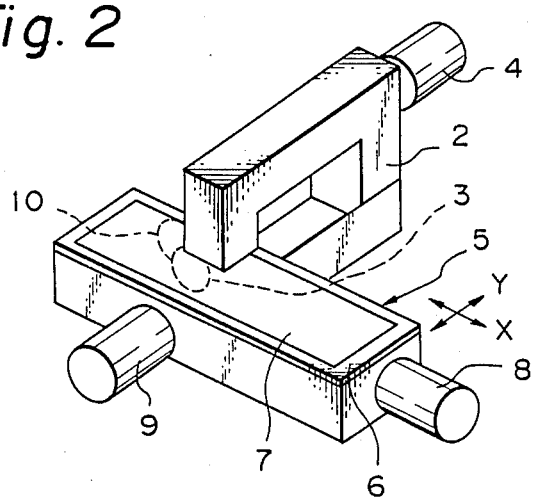
FIG. 2 is a fragmentary perspective view on an enlarged scale of a portion of the sewing machine shown in FIG. 1.

First of all, referring to FIGS. 1 and 2 of the drawings, these figures show a sewing machine to which the sewing rate control method and apparatus of the invention are applied. As more clearly shown in FIG. 1, the sewing machine has a sewing bed 1 and a sewing head 2 mounted on the upper surface of the bed 1. The sewing needle 3 is supported at the inner end of the sewing head 2 for vertically reciprocal movement relative to the sewing head 2 and is driven for upward and downward movement by, for example, a pulse motor 4 operatively connected to the sewing head. Positioned below the sewing needle 3 is the sewing table 5 which is mounted on the upper surface of the sewing bed 1 for horizontal movement on the bed. In the illustrated embodiment, the table 5 is movable in X and Y directions as shown in FIG. 2. The throat plate 6 is provided on the upper surface of the table 5 and a work 7 to be sewn is designed to be placed on the throat plate 6. Although not shown, the throat plate 6 is provided with a needle hole through which the needle 3 moves upwardly and downwardly. As more clearly shown in FIG. 2, the sewing table 5 is driven in the X direction by a pulse motor 8 and in the Y direction by a pulse motor 9, respectively.

As the sewing table 5 is moved in the X and Y directions by the motors 8, 9, respectively, the needle 3 moves reciprocally upwardly ad downwardly to form a predetermined number of stitches 10 on the work 7.

In the sewing machine illustrated and described hereinabove, the time period during which the needle 3 moves downwardly from the upper dead center through the work 7 and the needle hole in the throat plate 6 to the bottom dead center and then upwardly from the bottom dead center through the needle hole and work to the upper dead center is referred to as one cycle and this cycle is repeated until a predetermined number of stitches are formed on the work.

According to the present invention, monitoring means is provided for monitoring the position of the leading end of the moving needle 3. In the illustrated embodiment, the monitoring means has a counter 20 for counting pulses sent to the pulse motor 4. In the illustrated embodiment, the monitoring means continuously monitors the leading end of the moving needle 3 for at least the time period during which the leading end of the needle 3 is below the throat plate 6. Thus, movement of the needle is at least monitored for the time period during which, first of all, the leading ed of the needle begins to project beyond the needle hole in the throat plate, moves downward to bottom dead center, moves upwardly from the bottom dead center, and then enters the needle hole in the throat plate in the upward movement.

Figure 5:
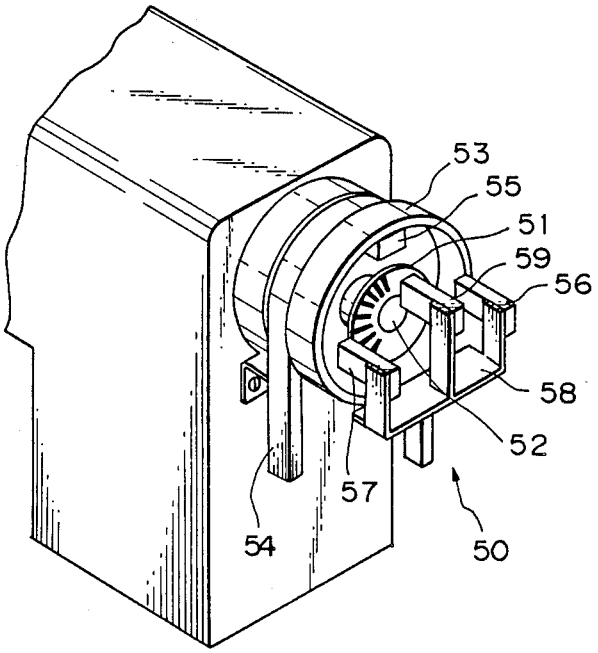
FIG. 5 is a fragmentary perspective view showing the arrangement of the components of the monitoring means and control means shown in FIG. 4.

Referring to FIG. 5 in which the monitoring means and control means of the invention is illustrated, the monitoring and control means is generally shown by reference numeral 50 and comprises a pulse generator board 51 secured to the upper shaft 52 of the sewing machine and similarly, a pulley 53 is secured to the upper shaft 52 and rotated by a sewing machine drive motor (not shown) through a V-belt 54 trained about the pulley 53. An upper and lower position detector magnet 55 is mounted on the pulley 53. Upper and lower position detectors 56, 57 and a pulse detector 59 are mounted on the sewing machine via a detector mounting board 58.

In order to stop the sewing machine in its normal position in which the needle 3 is stopped in a position adjacent to the upper dead center, when the upper position detector 56 detects the upper and lower position detection magnet 55, the sewing machine drive motor is stopped. Similarly, when the needle 3 is stopped in a position adjacent to the upper dead center with the needle piercing through the work in order to rotate the work, the pulse generator board 56 detects rotation rate of the sewing machine upper shaft 52 from the pulse detector 59 to thereby control rotational rate of the sewing machine drive motor.

The counter 20 is adapted to determie whether the leading end of the needle begins to enter the needle hole in the throat plate or the leading end of the needle is at 1809° or smaller. When the counter has determined the position of the needle end, the counter is reset with a signal from the upper position detector. That is, when it is assumed that 360 pulses are generated per rotation of the pulse generator board 51, the upper position detector 56 is detected and the pulse number is 0 whereas when the sewing machine upper shaft has rotated by 180°, the upper position detector detects 180 pulses and inputs the pulses to the counter 20. At this time, the counter outputs H signal. And when the sewing machine upper shaft has made another one complete rotation and the upper position of the needle is detected, the output of the counter becomes L. In this way, signals are detected at 180° and 360°. H and L signals from the counter 20 are input to the sewing machine control CPU to which rate data are input and CPU outputs sewing machine rate commands.

Figure 3:
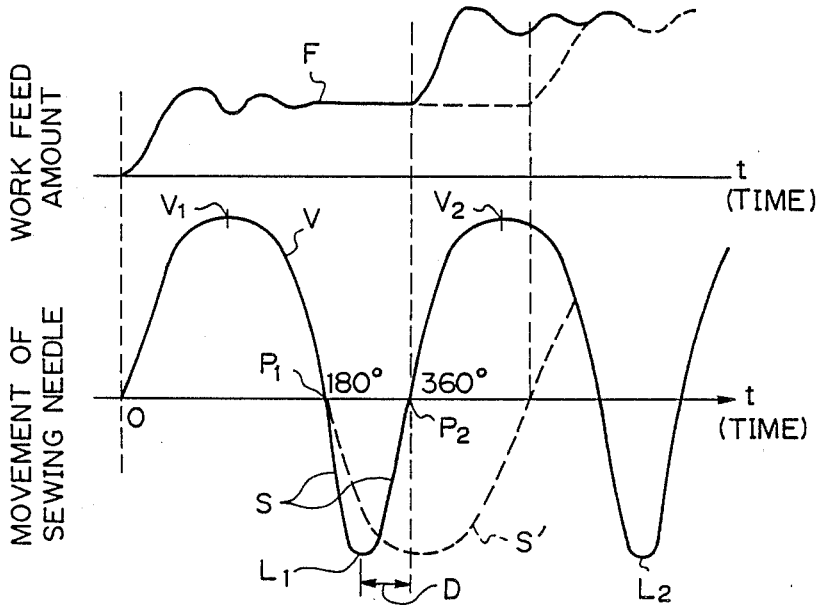
FIG. 3 is a graph showing the movement of the sewing needle against the work feed amount.
Figure 4:
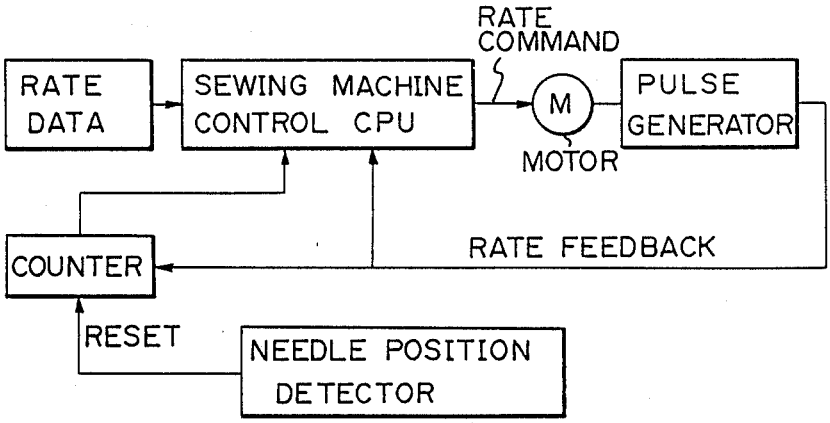
FIG. 4 is a schematic view of the monitoring means and control means of the sewing rate control apparatus according to the present invention.
Figure 6:
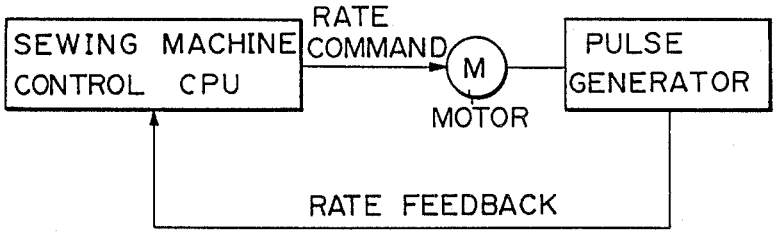
Fig. 6 ( PRIOR ART )
FIG. 6 is a schematic view of the conventional monitoring means and control means The above and other objects and attendant advantages of the present invention will be more readily apparent to those skilled in the art from a reading of the accompanying drawings which show preferred embodiments of the invention for illustration purposes only and not for the purpose of limiting the scope of the same in any way.

On the movement curve V of the needle 3 against the curve F of the feed amount of the work 7 shown in FIG. 3, it is assumed that $U_1$ and $U_2$ represent the upper dead center of the leading end of the needle 3 and $L_1$ and $L_2$ represent the bottom dead center of the leading end of the needle, respectively. And it is also assumed that the position (180°) where the leading end of the needle begins to enter the needle hole in the throat plate is indicated as $P_1$ and the position (360°) where the leading end of the needle clears the needle hole is indicatd as $P_2$, respectively. Then, during one cycle in which, first of all, the leading end of the needle moves downwardly from the first upper dead center $U_1$ through the position $P_1$ to the first bottom dead center $L_1$ and then upwardly from the first bottom dead center $L_1$ through the position $P_2$ to the second upper dead center $U_2$, the counter 20 counts the number of pulses sent to the pulse motor 4.

The monitoring means can monitor the leading end of the moving needle for the period during which the leading end of the needle moves from the positin $P_1$ through the first bottom dead center $L_1$ to the position $P_2$ in the upward movement that is, the time period during which the leading end of the needle is below the throat plate.

The monitoring means can also monitor the leading end of the moving needle for the period from the time just before the leading end of the needle contacts the work in the downward movement towards the bottom dead center to the time immediately after the needle end has passed through the work in the upward movement from the bottom dead center. Furthermore, the monitoring range of the monitoring means is not limited to the above-mentioned time periods and can be further extended.

The monitoring means can include a pulse amplifier 21 connected to the pulse motor 4 and reset means 22 connected to the counter 20. The reset means 22 is adapted to reset the counter 20 to zero when the leading end of the needle 3 is at upper dead center.

In the present invention, the monitoring means is not limited to the above-mentioned embodiment. For example, it is also contemplated that the monitoring means may comprise first detection means for detecting the leading end of the needle 3 when the needle end reaches the position $P_1$ in FIG. 3 and second detection means for detecting the leading end of the needle when the needle end reaches the position $P_2$ in the figure and continuously monitors the leading end of the needle from the time when the first detection means detects the needle end until the second detection means detects the needle end. In another embodiment, the monitoring means may be in the form of a timer which continuously times the leading end of the moving needle while the needle end is moving from the position $P_1$ to the position $P_2$. The detection means may also be, for example, in the form of a magnetic sensor or optical sensor.

Control means 30 is connected to the monitoring means for controlling the rotation of the pulse motor 4. The control means 30 comprises computing means for computing the number of pulses sent to the pulse motor 4 from the monitoring means and rate commanding means for controlling the pulse motor 4 so as to increase or decrease the rotational rate of the motor in response to the output of the computing means. The increase and decrease in the rotational rate of the motor 4 can be performed by, for example, varying the pulse frequency of the pulse motor. In the illustrated embodiment, while the leading end of the needle is below the throat plate 6, the control means 30 operates the pulse motor 4 at a rate higher than that at which the pulse motor is operated while the leading end of the needle is above the throat plate. The increase in rotational rate of the pulse motor is shown by the curve S in FIG. 3. That is, while the monitoring means is monitoring the needle end which is then above the throat plate, the control means 30 increases the rotational rate of the motor 4 to thereby increase the movement rate of the needle 3.

In FIG. 3, the broken curve S' represents the movement of the needle in a conventional sewing machine. As clear from FIG. 3, in the sewing machine to which the present invention is applied, the movement rate of the needle is higher than that of the needle in the conventional sewing machine by an amount equivalent to one stitch, shown by D, per unit of time.

The control means and monitoring means can be placed in a single box 40 fixedly secured to the sewing bed 1 as shown in FIG. 1.

In another embodiment, the motor for driving the sewing machine may be a servo-motor the rotational rate of which can be varied by controlling the current or frequency supplied thereto.

As is clear from the foregoing description of the embodiments of the invention, since the needle is accelerated while the leading end of the needle is below the throat plate to thereby increase the overall sewing rate of the sewing machine, a sewing operation can be performed rapidly.

Various modes of carrying out the invention are contemplated as being within the scope of the following claims which specifically recite and distinctly claim the subject matter which is regarded as representing the invention.

What is claimed is:

1. In a method of controlling the sewing rate in a sewing machine comprising a reciprocally and vertically movable needle, a motor for driving said needle and a throat plate on which a workpiece is adapted to be placed having a needle hole through which said needle moves, said sewing machine being adapted to repeatedly perform a cycle wherein the needle moves downwardly from the upper dead center to the bottom dead center passing through said needle hole and then upwardly from the bottom dead center to the upper dead center passing through the needle hole, the improvement wherein while said needle is below said throat plate the needle is moved at a rate higher than that at which the needle is moved while the needle is above the throat plate.

2. A sewing machine comprising a reciprocally and vertically movable needle, a motor for driving said needle and a throat plate on which a workpiece is adapted to be placed having a needle hole through which the needle moves, said sewing machine being adapted to repeatedly perform a cycle wherein the needle moves downwardly from the upper dead center to the bottom dead center passing through said needle hole and then upwardly from the bottom dead center to the upper dead center passing through said needle hole, the apparatus for controlling the sewing rate in said sewing machine comprising monitoring means for monitoring the leading end of said needle while the needle end is at least below said throat plate and control means connected to said monitoring means for controlling the rotation of said motor, said control means being operable to increase the rotational rate of said motor in response to the operation of said monitoring means so that while the needle is below said throat plate the needle is moved at a rate higher than that at which the needle is moved while the needle is above said throat plate.

3. The apparatus for controlling the sewing rate in a sewing machine as set forth in claim 2 wherein said monitoring means has a counter for counting the number of pulses supplied to said motor.

4. The apparatus for controlling the sewing rate in a sewing machine as set forth in claim 2 wherein said monitoring means further includes a pulse amplifier connected to said motor and reset means for resetting said counter.

5. The apparatus for controlling the sewing rate in a sewing machine as set forth in claim 2 wherein said control means comprises computing means for computing the number of pulses supplied to said motor and rate commanding means for increasing or decreasing the rotational rate of the motor in response to the output of said computing means.

* * * * *